US006220166B1

(12) United States Patent
Cherry

(10) Patent No.: US 6,220,166 B1
(45) Date of Patent: Apr. 24, 2001

(54) APPARATUS AND METHOD FOR PRODUCING FRAGMENT-FREE OPENINGS

(75) Inventor: Christopher R. Cherry, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/365,655

(22) Filed: Aug. 2, 1999

(51) Int. Cl.[7] ..... F42B 1/00

(52) U.S. Cl. ..... 102/305; 102/306; 102/701; 86/50; 89/1.14; 72/55; 72/56; 72/430; 72/706

(58) Field of Search ..... 86/49, 50; 102/303, 102/305, 306, 311, 312, 701, 293, 307–310, 475, 378; 72/55, 56, 430, 706; 588/202, 203; 89/1.14

(56) References Cited

U.S. PATENT DOCUMENTS

| | | | | |
|---|---|---|---|---|
| 3,076,408 | * | 2/1963 | Poulter et al. | 102/701 |
| 3,374,737 | * | 3/1968 | Pike | 102/307 |
| 3,712,221 | * | 1/1973 | Voigt, Jr. et al. | 102/378 |
| 3,896,731 | * | 7/1975 | Kilmer | 102/701 |
| 4,046,055 | | 9/1977 | McDanolds et al. . | |
| 4,169,403 | | 10/1979 | Hanson . | |
| 4,408,535 | * | 10/1983 | Alford | 102/305 |
| 4,589,341 | * | 5/1986 | Clark et al. | 86/50 |
| 4,628,819 | | 12/1986 | Backofen, Jr. et al. . | |
| 4,955,939 | | 9/1990 | Petrousky et al. . | |
| 4,957,027 | | 9/1990 | Cherry . | |
| 5,149,911 | * | 9/1992 | Ringbloom et al. | 102/312 |
| 5,221,396 | * | 6/1993 | Kane | 156/250 |

OTHER PUBLICATIONS

Chick, M., et al., "Predictable Disposal of Munitions with Shaped Charges, " Materials Research Laboratory, DSTO, Melborne, Australia, date unknown, 1–18.

James, H.R., "TTCP WAG–11 Bullet/Fragment Protocol (Version 2.0) ," AWE (Foulness) , UK, Nov. 1993, 1–16.

Mader, Charles, et al.,"Jet Initiation of Explosives," Los Alamos National Laboratory report LA–8647, Feb. 1981, 1–9.

Moulard, H., "Critical Conditions for Shock Initiation of Detonation by Small Projectile Impact," date unknown, 316–324.

* cited by examiner

*Primary Examiner*—Harold J. Tudor
(74) *Attorney, Agent, or Firm*—Timothy Stanley

(57) ABSTRACT

An apparatus and method for explosively penetrating hardened containers such as steel drums without producing metal fragmentation is disclosed. The apparatus can be used singularly or in combination with water disrupters and other disablement tools. The apparatus is mounted in close proximity to the target and features a main sheet explosive that is initiated at least three equidistant points along the sheet's periphery. A buffer material is placed between the sheet explosive and the target. As a result, the metallic fragments generated from the detonation of the detonator are attenuated so that no fragments from the detonator are transferred to the target. As a result, an opening can be created in containers such as steel drums through which access to the IED is obtained to defuse it with projectiles or fluids.

25 Claims, 4 Drawing Sheets

APPARATUS AND METHOD FOR PRODUCING FRAGMENT-FREE OPENINGS

This invention was made with Government support under Contract DE-AC04-94AL85000 awarded by the U.S. Department of Energy. The Government has certain rights in the invention.

BACKGROUND OF THE INVENTION

The present invention relates generally to the field of producing fragment-free openings with the use of explosive materials and more specifically an apparatus and method for creating openings in housings for improvised explosive devices (IEDs) without setting off the IED.

Very frequently, IEDs are placed in hardened enclosures, such as steel drums, ammo boxes, or the like. This occurs because the perpetrator wants to make it difficult or impossible for the bomb to be disarmed before it detonates. Frequently, these enclosures are booby-trapped so that if their lids are pried off, the IED will explode.

Various techniques have been in place in the field of Explosive Ordinance Disposal (EOD) for creating openings in the hardened container of the IED as a first step in disablement. Typically, linear-shaped charges are used to create such openings. These shaped charges consist of a chevron-shape metallic casing, which is usually copper, aluminum or lead, that contains a set quantity of high explosives, such as RDX or PETN (pentaerythritoltetranitrate). The linear-shaped charge cuts the metal casing by accelerating the metal envelope in the wedged (or chevron-shaped) portion of the charge into each other, thus creating a high-velocity metallic jet. This metallic jet is capable of penetrating or cutting steel and other hardened targets. The linear-shaped charges can also send fragments into the target and to the surroundings. Other high-explosive charges that have no metal case that are employed in direct contact with the surface of a metallic target generally produce fragments by inducing multiple stress transients into the target, resulting in spallation of the back of the target.

In essence, spallation occurs when a typical high-explosive charge is detonated in contact with a hardened target, such as a steel plate. As a result, the charge can cut, punch or tear a hole in the steel plate directly underneath the charge. The cutting or punching process is due to the high-intensity shocks generated by the explosive charge. These high-intensity shocks compress and put in tension the steel in nanosecond to microsecond time frames. If strong enough, the pressure generated from the shock perturbations in the steel can overcome the critical fracture stress level in the steel so that steel will fracture. When explosively generated shocks travel through the steel, it compresses the steel. When this compressive wave reaches a free boundary (i.e., air) having a lower shock impedance than steel, to conserve momentum, part of the shock will reflect back into the steel, placing the steel into tension. Tension waves generated from high-intensity shocks can cause the steel to be pulled apart in a laminar fashion from the free surface opposite the explosive charge. The process of steel being separated in this laminar-like fashion is called "spallation." The spalling process produces secondary fragments from the main piece of steel that is under explosive attack.

In contact operations for explosively cutting steel, generally a main piece of steel is cut from the surface that can travel at high velocities along with the pieces that have spalled from the main piece of steel, resulting in high-energy, high-velocity fragments. In EOD operations, the impact of fragments can initiate the target explosives. Therefore, the generation of fragments is undesirable. In Special Weapons and Tactics-type (SWAT) operations, explosively generated fragments can injure or kill personnel; therefore, a high-explosive charge capable of generating no fragments is highly desirable.

In the art of bomb disablement, most terrorist-type bombs are defused remotely by a disrupter. A disrupter is a tool designed to fire remotely a variety of projectiles into a terrorist-type bomb to disable/dislodge the circuit or other bomb components. The most common projectile is water; however, in order to penetrate steel containers containing sensitive explosives without shock-initiating the explosives, water alone is not a suitable candidate. Thus, one of the objectives of the present invention, when an IED is enclosed in a steel or other hardened container, is to be able to create a fragment-free portal through the steel container without setting off the IED. This fragment-free hole can be made in microseconds prior to water from a disrupter arriving at the target interface. Thus, the tandem capability offers a new level of advanced capabilities in the art of bomb disablement.

The present invention can be used to disable bombs, ordnance, for explosive entry for hostage rescue, and in industrial applications for explosive diaphragms for venting hazardous containers or other extreme environments. The present invention has the ability to create a cruciform-shaped cut or slit in a steel target and subsequently peel back the steel, thus creating a generally large, symmetrically shaped square or rectangular hole in a steel target and is generally referred to as "Magic Cube™" by the inventor. This hole is produced with a greatly reduced shock pressure induced inside the metal container where the target is located.

Thus, among the advantages of the present invention are to be able to use controlled explosive charge that produces a fragment-free hole in a hardened target. Another advantage of the present invention is to create the apparatus from readily available materials. The present invention can be used alone, in tandem, or in multiple combinations with other disablement projectiles in the field of EOD. Another advantage of the invention is to use an explosive charge with controlled shock pressures which can be detonated on the surface of a hardened target or container containing sensitive explosives (i.e., nitroglycerin/nitroglycol-based dynamites, and/or lead azide-based detonators) that are positioned only inches away from the charge without initiating any of the sensitive explosives. Another advantage of the invention is to provide an apparatus that, by design, can absorb the fragments generated by a detonator and produce no fragments into the target. This allows the charge to be fired in close proximity to personnel for military or police operations and in the field of special effects for the motion picture industry. Yet another objective of the present invention is to be able to allow personnel in SWAT teams and military hostage extrication teams to use the apparatus and method to create controlled explosive entry. These types of teams, whether military or civilian, can also use the apparatus of the present invention to produce viewing ports and gun portals in dealing with hostage situations.

Yet another advantage of the present invention is to provide the ability to produce instantaneous low-pressure, fragment-free holes through steel bulkheads and damaged buildings or ships or to allow urban rescue personnel to gain access for placing oxygen or air hoses, lighting or microphones for persons trapped on the other side of a bulkhead.

Another application of the present invention is to use the present invention on a flat, steel plate or a domed surface which can serve as an economical explosive fragment-free explosive diaphragm that could be used in industrial hazardous environments for mixing or venting of materials in tanks. Yet another objective of the present invention is to be able to configure the apparatus in different sizes and configurations to create entry holes of different sizes on targets having a variety of thicknesses and constructed from a variety of materials. Yet a further objective of the invention is to be able to deliver the apparatus manually or robotically and to be able to easily affix the apparatus to a target having surfaces which may be curved or wet to create portals therein.

Yet another advantage of the present invention is to successfully penetrate a variety of hardened targets, such as, for example, steel targets having a thickness of 0.035–0.125" which contain a nitroglycerin-based dynamite as close as 2" from behind the target interface without initiating the dynamite. Yet another objective is to produce portals or openings as large as 9" in diameter in steel enclosures as thick as 0.25". Yet another objective of the present invention is to produce fragment-free holes in metallic targets that are very large as compared to the surface area of the charge. Thus, depending on the loading vs. the steel target thickness, the apparatus can produce holes in steel targets ranging in size from the charge's surface area to greater than 8 times the charge's surface area.

How the present apparatus and method are accomplished can be more readily understood by those skilled in the art from a review of the description of the preferred embodiment that appears below.

SUMMARY OF THE INVENTION

An apparatus and method for explosively penetrating hardened containers such as steel drums without producing metal fragmentation is disclosed. The apparatus can be used singularly or in combination with improvised explosive device (IED) disrupters and other disablement tools. The apparatus is mounted in close proximity to the target and features a main sheet explosive that is initiated at preferably four equidistant points along the sheet's periphery. A buffer material is placed between the sheet explosive and the target. As a result, the metallic fragments generated from the detonation of the detonator are attenuated so that no fragments from the detonator are transferred to the target. As a result, an opening can be created in containers such as steel drums through which access to the IED is obtained to defuse it with projectiles or fluids.

DETAILED DESCRIPTION OF THE INVENTION

Figure 1:
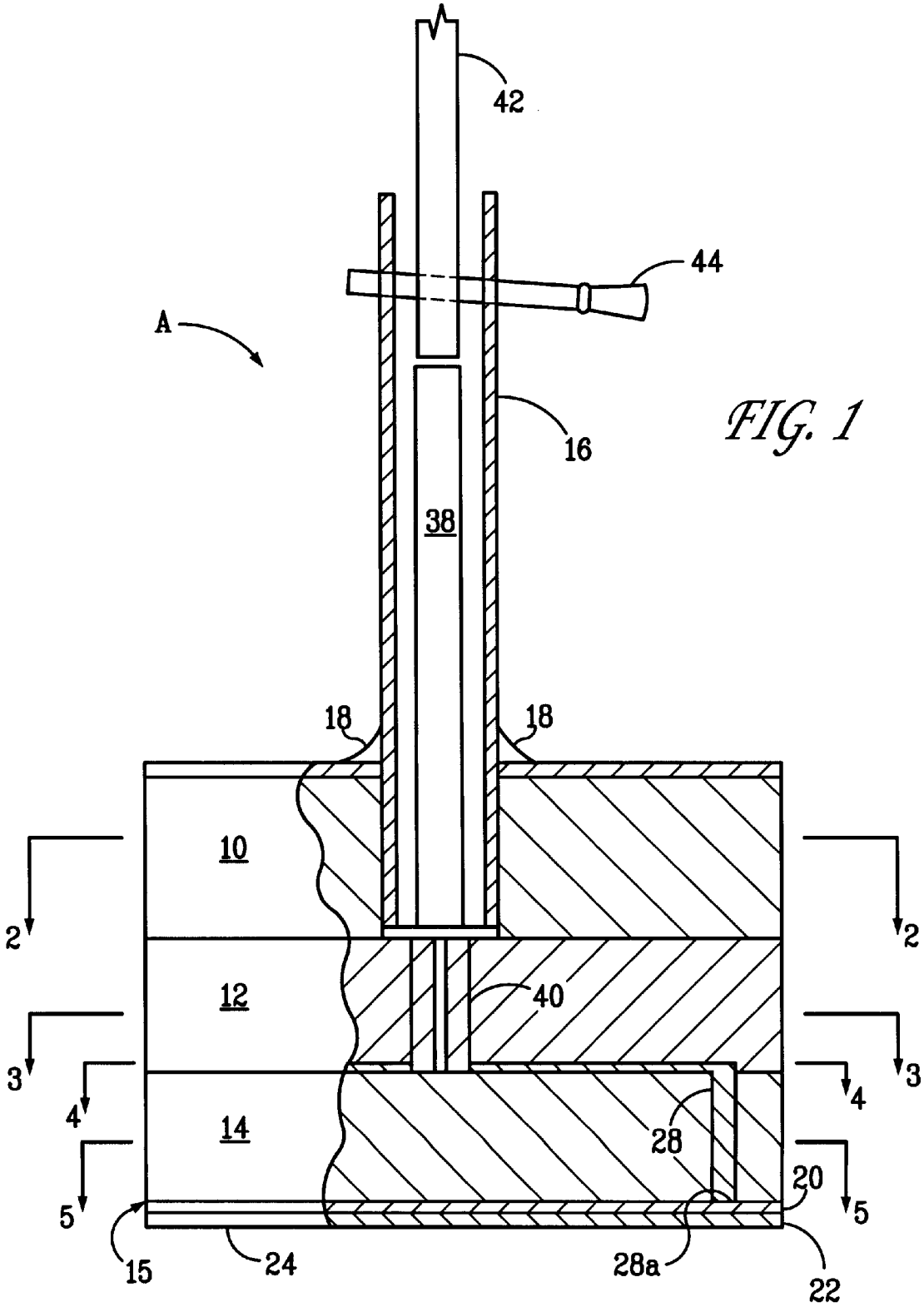
FIG. 1 is a sectional elevational view of the apparatus of the present invention.

Referring to FIG. 1, a first embodiment of the invention A includes three pieces of a low-density material, such as closed cell polyethylene foam, labeled 10, is 12, and 14 mounted one atop the other. Foam blocks 10, 12 and 14 comprise a shock buffer that will be discussed later. The configuration of the foam blocks 10, 12, or 14 can be circular, square, rectangular, or any other shape. The thickness can also be varied. One example is to use blocks 10, 12, or 14 that are approximately ½" thick and that range, in a square configuration, from 1" to greater than 8". A tube 16 extends into block 10 and is attached with epoxy 18. Tube 16 serves as a detonator well. Tube 16 is preferably made from a piece of plastic tubing, approximately 3" long in one example, with an inside diameter of 0.33" and an outside diameter of approximately 0.375". The preferred epoxy sets up in approximately 5 minutes. Mounted below block 14 is a sheet explosive 20, which in one example can vary in thickness from 0.025" to 0.33" and in diameter, if round, from 1" to 8–10". In the preferred embodiment, the sheet explosive 20 is a PETN-based sheet explosive containing superfine crystalline PETN. This type of explosive propagates in thin diameters, i.e., 0.060". The sheet explosive 20 is affixed to the foam block 14 with preferably a commercial thin, two-sided carpet tape 15. Secured to the underside of sheet explosive 20 is a thick, two-sided foam tape 22 can serve as a shock wave attenuator and for attaching the apparatus A to an IED. The exposed adhesive face 24 of foam tape 22 can have a removable plastic insulating layer (not shown) to protect face 24 which is ultimately attached to the target when the apparatus A is ready for use.

Blocks 10, 12 and 14 are enveloped on all sides except face 24, with cloth tape (not shown) (which holds blocks 11,12, and 14 together as one unit) approximately ½" wide, covers all sides and the top, leaving the bottom so that the foam tape 22 is exposed for ultimate adhesion to the target when the protective layer (not shown) on the foam tape 22 is peeled away to expose face 24 of foam tape 22. The cloth tape 26 can be color-coded to signify the power level of the explosives in the apparatus A. In one example, the preferred thickness of the foam tape 22 is approximately 0.0625". Other materials and thicknesses can be used as a shock wave attenuator, the main criteria being a separation of the sheet explosive 20 from the metal target and the use of a soft or compliant material so as to attenuate the shock wave. Those skilled in the art can appreciate that readily available materials can be used and their effectiveness readily evaluated with a simple test on an enclosure which has no IED inside.

Figure 2:
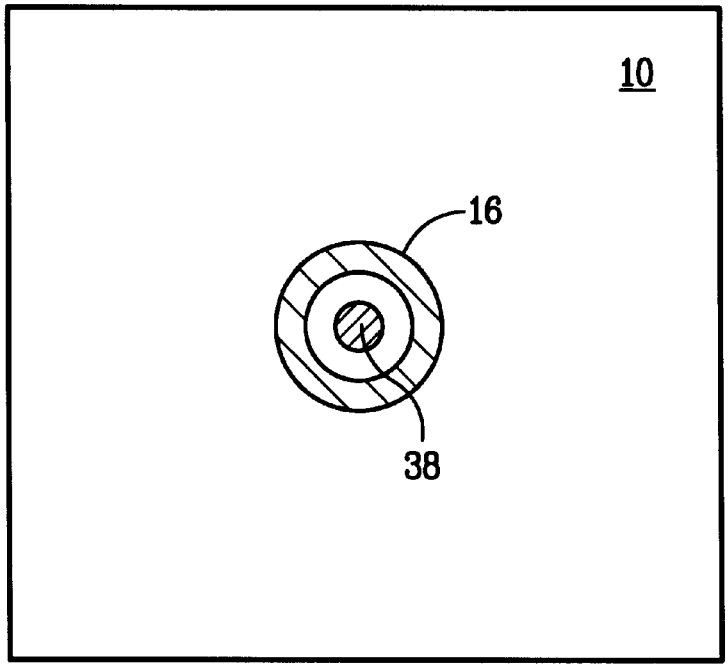
FIG. 2 is a cross-sectional view of FIG. 1 along section line 2—2.
Figure 3:
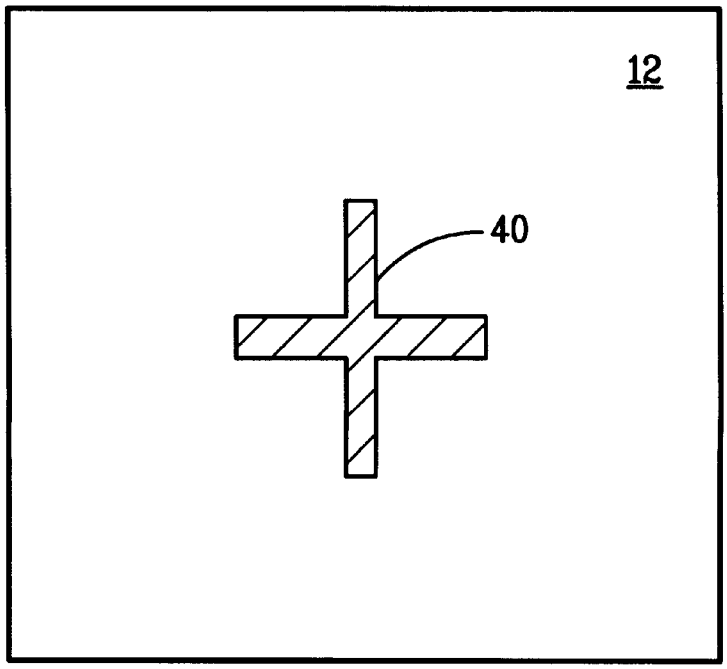
FIG. 3 is is a cross-sectional view of FIG. 1 along section line 3—3.
Figure 4:
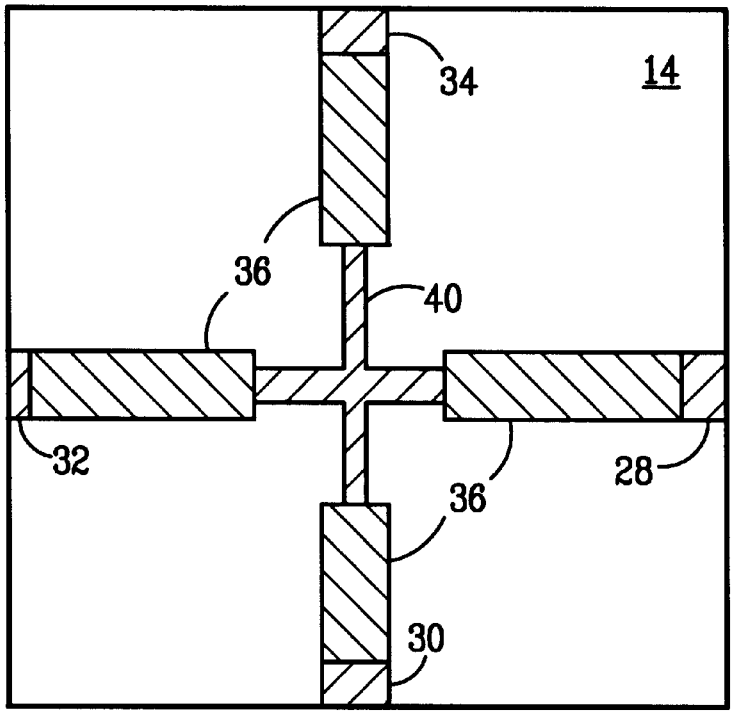
FIG. 4 is a cross-sectional view of FIG. 1 along section line 4—4.
Figure 5:
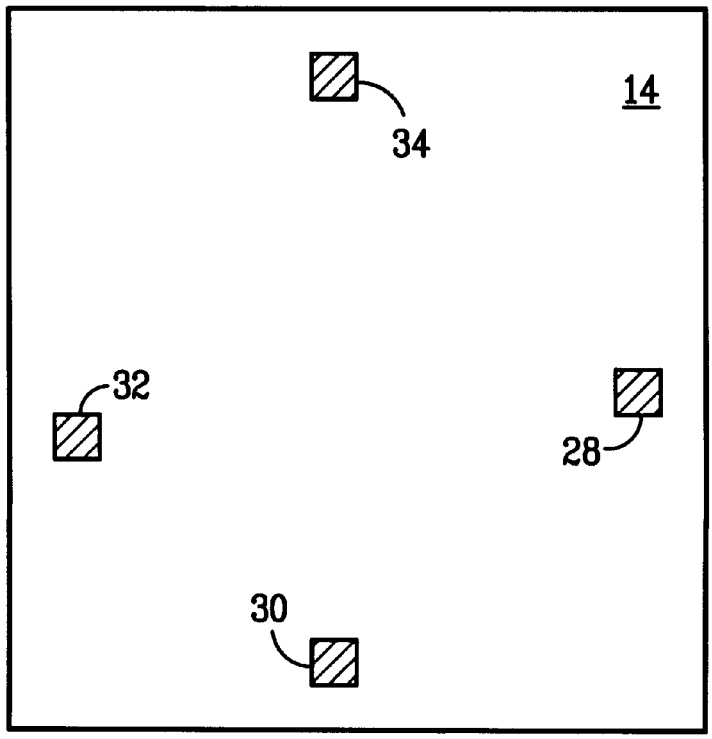
FIG. 5 is a cross-sectional view of FIG. 1 along section line 5—5.

The initiation system comprises thin strips of PETN-based sheet explosive or PETN detonating cord which, in the preferred embodiment, has a core load as small as 5 grains/ft to 50 grains/ft. The strips are best seen in FIGS. 1, 4 and 5 as items 28, 30, 32, and 34. These strips are preferably oriented perpendicularly to the sheet explosive 20. An explosive transfer cross 36 is mounted between blocks 12 and 14, and has its terminal points at strips 28, 30, 32, and 34, respectively. Although the transfer cross 36 is shown as a cross shape, other types of shapes can be used with a greater or lesser amount of strips, such as 28–34, without departing from the spirit of the invention. The preferred embodiment shown in FIGS. 1–5 is a square shape, using four strips 28–34. However, other shapes of foam blocks 10–14 and different configurations and amounts of strips such as 28–34 can be deployed without departing from the spirit of the invention. The cross 36 can be constructed from PETN-based detonating cord. The strips 28–34 are placed in block 14 by predrilled holes in block 14. The cross 36 is symmetrically spaced between the blocks 12 and 14 so that the center hub 40 of the cross 36 is aligned with the first piece of detonating cord 38, which is contained within to the tube 16, as seen in FIG. 2. Transfer cross 36 is affixed between blocks 12 and 14 using two-sided carpet tape (not shown). A shock detonator 42, is inserted into tube 16 and a tie wrap 44, is used to secure it.

The apparatus A is constructed from soft shock- and fragment-attenuating materials and is designed to be fired in extremely close proximity to sensitive explosives, as in the case of EOD operations, or in close proximity to personnel in the case of controlled explosive entry for hostage-extrication teams. The purpose of the initiation system previously described is two-fold. The primary function is to simultaneously initiate the main sheet explosive 20 at preferably equidistant points, in this case four, which are closer to the sheet's periphery than its center. Other arrangements which are not equidistant can be used without departing from the spirit of the invention. The second main function is to attenuate the metallic fragments generated from the detonation of the detonator, i.e., shock tube 42 and tube 16, so that no fragments from the detonator are transferred into the target.

The apparatus A can be constructed from a variety of materials, including but not limited to injection-molded explosives (ECX-108 or XTX-8003) and injection-molded foam, balsa wood, or any combination of fixture materials, and explosives which can propagate in small diameters.

The apparatus A is designed so that any type of commercial or military detonator or initiator initiates the charge. In operation, the detonator, which includes, for example, shock tube 42 and tube 16, initiates the central primary explosive train, such as detonating cord 38, from which point the detonation traverses downward and terminates into the hub or center 40 of the four-point initiation cross 36. Thereafter, the strips 28–34 are initiated with a high degree of isochronicity (<125 nanoseconds in the preferred embodiment).

The flat sheet of explosive 20 is initiated at four preferably equidistant points (28*a*, 30*a*, 32*a*, 34*a*) close to or along the periphery or outer edge of the explosive. The detonation of the sheet explosive 20, beginning at the four points (28*a*, 30*a*, 32*a*, 34*a*) at the lower ends of strips 28–34, spreads out radially R and collides at intersecting lines or planes 46, 48, creating a very high, intense shock pressure, which is approximately 2–8 times the normal shock pressure. This high-intensity shock pressure travels through the foam tape 22 and into the steel, and cracks or cuts the metal target directly underneath the collision lines 46 and 48, shown in FIG. 6, thus creating fracture lines in the steel that are 90° apart from each other, i.e., collision lines 46 and 48. The fracture lines 46 and 48 meet in the steel directly underneath the charge's center at point 50 and create a cruciform-shaped pattern or cut into the steel. The four explosively generated cuts create four triangular-shaped metal petals 52–58, whose apexes intersect each other directly adjacent to the center axis of the explosive charge at point 50. The metal petals 52–58 are affixed to the main body of steel by a hinge of uncut steel that is at the base 60–66, respectively, of petals 52–58. While four detonator points (28*a*, 30*a*, 32*a*, 34*a*) are depcted in this embodiment, those skilled in the art will appreciate that three or more equidistant detonation points can also be employed. Moreover, the three or more detonation points need not be equidistant, one from the other. The result of non-equidistant detonation points is simply to create petals in non-equal areas.

The shock and gas pressure generated from the sheet explosive 20 pushes downward on the steel petals 52–58 and begins to accelerate the petals 52–58 downwardly, outwardly, and away from the target surface. The downward and outward projection of the metal petals 52–58 is due to first accelerating the free apex ends. The apex ends act as a freestanding body momentarily and are no longer attached to the main steel. The acceleration process of the petals 52–58 continues with the apex end first, followed by a slower acceleration of the remaining portion of the triangular-shaped petals 52–58. The longer impulse is generated from the center portion of the charge, and the explosive sheet 20 imparts the highest velocity in the apex region of each petal. Since the petals 52–58 are still attached at the respective bases 60–66, the metal bends downward and outward away from the center of the charge.

As the petals 52–58 accelerate downwardly and outwardly, they begin to tear the steel along the fracture lines or collision lines 46 and 48, and such tearing continues beyond the base of the charge, which is defined as the area encompassed by the triangularly shaped metal petals which are directly underneath or adjacent the outer periphery of the explosive charge. Thus, the propagation continues along lines 46 and 48 to expose an opening far larger than the original dimensions of the apparatus A as measured by the dimensions of the sheet explosive 20. The resulting opening in the above-described embodiment is a square-shaped hole larger than the original charge 20 in the steel plate or the target. Roundish, rectangular or other polygonal shapes can be created. By design this continued tearing of the metal is desirable. The remaining kinetic energy in the four petals tears the steel along the fracture lines 46 and 48, resulting in producing holes that have a surface area that can be eight times the surface area of the charge 20 or even more.

The foam tape 22 attenuates or absorbs some of the shock energy from the explosive. Since the tape 22 is porous, it is thus energy-absorbing and therefore reduces the peak shock pressure and lengthens the shock pulse that is transmitted into the steel. The reduction of shock energy prevents the explosive charge from cutting the steel underneath the periphery of the explosive and prevents the steel from spalling, as well as reducing the velocity of the metal petals. The velocity reduction of the steel petals 52–58 prevents the steel petals from being accelerated at too high velocity. If the petals 52–58 are accelerated at too high a velocity, they could break off at the respective bases 60–66 and thus form undesirable fragments. Reducing the velocity of the petals 52–58 is desirable so that if during bending they impact sensitive explosives, the impact pressure generated will not be sufficient to shock-initiate the sensitive explosives.

The foam tape 22 serves the purpose of counteracting undesirable high-stress zones resulting from the shocks transmitted into the steel, which are created in the steel underneath the outer periphery of the explosive charge 20. This high-stress zone is due to a combination of shock rarifications at the outer periphery of the explosive charge and the reflections at the boundary of the compressed steel and uncompressed steel at the charge's edge. The high-stress zone forms a triple point in the steel directly underneath the outer edge of the charge. This high-stress zone can cause the steel to form a fracture along the periphery of the explosive charge (i.e., along base lines 60–66), cutting out the steel underneath in a cookie-cutter fashion which can propel the steel petal to a high velocity. This undesirable characteristic is prevented using the foam tape 22. In the preferred embodiment, the thickness of the foam tape 22 is in the order of 0.0625". Other attenuating materials can be used for this purpose in other configurations and thicknesses without departing from the spirit of the invention.

Figure 6:
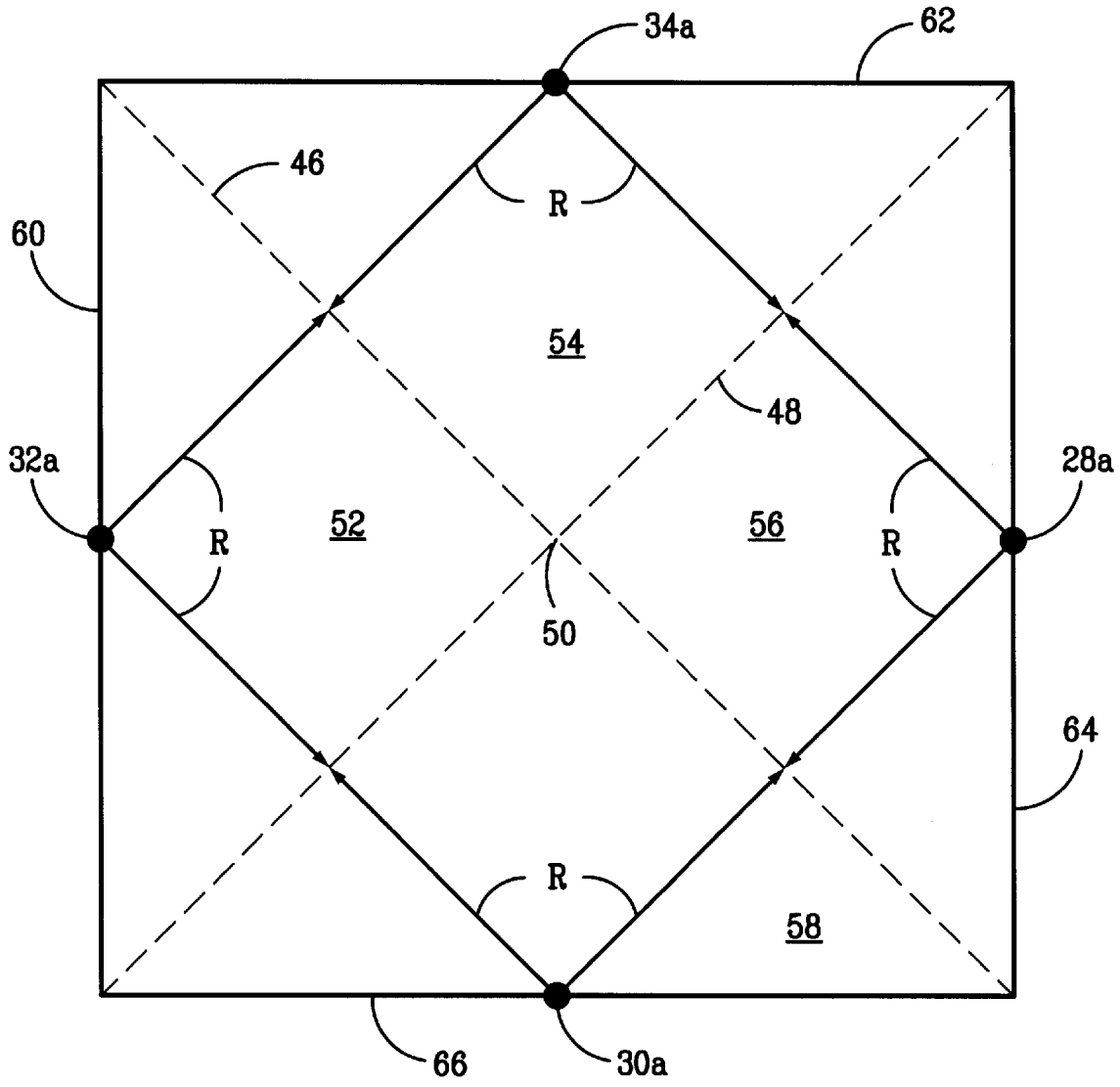
FIG. 6 is a view of the object to be penetrated, showing how the petals are formed.

The apparatus A of the present invention can be used in one or more locations on a steel or other enclosure for an IED to make one or more penetrations into the enclosure, which in turn can be instantaneously or shortly thereafter followed by a projectile or fluid expelled from a disrupter, shown schematically as arrow 53 in FIG. 6, which itself is remotely actuated and designed to enter the opening made by the movement of the petals 52–58 in a very short time period after they are bent back from actuation of the apparatus A. Multiple penetrations can be made with multiple placements of the apparatus A in different locations on an enclosure for an IED. As previously stated, other applications are also possible to allow the creation of openings in steel or other hard objects without damage to adjacent equipment or personnel.

While any detonator can be used to detonate the apparatus A, for precise timing where the apparatus A has to be timed with other charges or disruptive tools, detonators, i.e., shock tube detonators, with a precise timing or small firing time isochronicity are preferred. The sheet explosive 20 is typically but not limited to a PETN-based sheet explosive capable of propagating in small diameters of 0.060" and in thickness of 0.025". The initiation cross 36 is made from, but not limited to, a stamped out, single piece of Primasheet 1000 (a 63% PETN-based sheet explosive) which is currently manufactured by the Ensign-Bickford Co. in Graham, Ky. The explosive transfer lines or strips 28–34 can be manufactured from the PETN-based sheet explosive and in a preferred embodiment can be 0.042" thick by 0.070" in width, or a PETN-based detonation cord ranging from 5–50 grains/ft explosive coreload.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for creating an opening in a barrier, comprising:

a) an explosive charge secured to a support;

b) a buffer material on said support and disposed between said charge and the, barrier wherein the buffer material is adapted to be mounted on the barrier, c) means for setting off said explosive charge and creating an explosive force, wherein said explosive force causes the barrier to fail from an initial point and along intersecting failure lines thus defining a plurality of petals cantilevered from the barrier which are pushed by said explosive force to define a fragment-free opening in the barrier.

2. The apparatus of claim 1, wherein said explosive is in sheet form.

3. The apparatus of claim 2, wherein said means sets off said sheet at at least three locations.

4. The apparatus of claim 3, wherein said detonating means sets off said locations on said sheet at substantially the same time.

5. The apparatus of claim 4, wherein said locations are substantially equidistant from each other.

6. The apparatus of claim 3, wherein said locations are substantially equidistant such that when said explosive charge is set off, the barrier fails from a starting point equidistant from said locations and along failure lines that extend from said point toward said locations, thus defining a plurality of triangular, cantilevered petals which are pushed by said explosive force to define a fragment-free opening in the barrier.

7. The apparatus of claim 1, wherein said support is made substantially from a shock-attenuating material.

8. The apparatus of claim 7, wherein said material for said support comprises foam.

9. The apparatus of claim 2, wherein said buffer material extends to at least the dimension of said sheet and further comprises a shock-attenuating material.

10. The apparatus of claim 9, wherein said buffer material comprises foam having an adhesive material on a face thereof to facilitate attaching said apparatus to the barrier.

11. The apparatus of claim 1, wherein said opening is polygonal or round in shape formed by substantially triangularly shaped petals which are pushed by said explosive force to create the opening in the barrier.

12. The apparatus of claim 1, wherein said opening created by setting off said explosive charge is greater than the size of said support.

13. The apparatus of claim 1, wherein said means for setting off the explosive material further comprises an explosive transfer device connected to a plurality of strips which in turn are operably connected to at least three discrete locations on said explosive charge.

14. A method of making a fragment-free opening in a barrier, comprising:

a) securing an explosive to a buffer material;

b) securing the buffer material to the barrier;

c) setting off the explosive and creating an explosive force; and d) creating an opening in the barrier by failing the barrier along intersecting lines of failure with the explosive force into a plurality of petals that remain attached to the barrier after displacement to define the opening.

15. The method of claim 14, further comprising:

a) using sheet explosive;

b) setting off said sheet explosive in at least three locations.

16. The method of claim 15, further comprising spacing said locations equidistant from each other.

17. The method of claim 14, further comprising:

a) encasing said sheet explosive with a shock-attenuating material;

b) supporting a detonating device in said attenuating material which branches to each of said locations on said sheet;

c) providing foam as a buffer between said sheet and the barrier.

18. A method of forming a fragment-free opening in a barrier, comprising:

a) initiating an explosive material mounted on the barrier and creating shock pressure;

b) creating at least two intersecting fracture plane in the barrier with the shock pressure; and c) propagating fractures in the barrier along the intersecting fracture planes to form a plurality of cantilevered petals defining an opening in the barrier.

19. The method of claim 18, further including attenuating the shock pressure with shock attenuating material interposed between the explosive material and the barrier.

20. The method of claim 19, wherein the attenuated shock pressure limits fracturing of the barrier along the periphery of the explosive material.

21. The method of claim 18, further including forming a plurality of triangular shaped petals in the barrier wherein the apexes of the petal intersect at the point of intersection of the fracture planes.

22. The method of claim 18, further including bending the petals in the direction of propagation of the shock pressure starting at the apex of each petal without detaching the petal from the barrier.

23. The method of claim 18, further including attenuating the velocity of bending of the petals by attenuating the shock pressure with a shock attenuating material interposed between the explosive material and the barrier, whereby the petals remain attached to and cantilevered from the barrier.

24. An apparatus for creating a fragment-free opening in a barrier, comprising:

a) an explosive charge;

b) shock attenuating material encapsulating all but one surface of the explosive charge;

c) a buffer material mounted on the one surface of the explosive charge not encapsulated with shock attenuating material;

d) adhesive means with the buffer material for mounting the apparatus on the barrier;

e) means for setting off the explosive charge and creating an explosive force, wherein the explosive force creates intersecting lines of failure in the barrier whereby the barrier fails from an initial point and along the intersecting failure lines thus forming petals cantilevered from the barrier and defining an opening therein.

25. An explosive apparatus for creating a fragment-free opening in a barrier, comprising:

a) a shock absorbent;

b) an explosive material mounted with the shock absorbent;

c) a shock buffer mounted with the explosive material having an adhesive surface adapted for attaching the apparatus to the barrier such that the shock buffer is interposed between the explosive material and the barrier; and d) a detonator mounted in the shock absorbent and configured so as to set off the explosive material at at least three locations wherein intersecting planes of fracture are created in the barrier by the shock pressure from the detonated explosive material thus forming petals cantilevered from the barrier and defining an opening therein.

* * * * *